US011479037B2

(12) United States Patent
Kanno et al.

(10) Patent No.: US 11,479,037 B2
(45) Date of Patent: Oct. 25, 2022

(54) LIQUID DISCHARGING HEAD

(71) Applicant: CANON KABUSHIKI KAISHA, Tokyo (JP)

(72) Inventors: Hideo Kanno, Yokohama (JP); Nobuyuki Hirayama, Fujisawa (JP); Ryo Kasai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/025,855

(22) Filed: Sep. 18, 2020

(65) Prior Publication Data

US 2021/0094286 A1 Apr. 1, 2021

(30) Foreign Application Priority Data

Sep. 27, 2019 (JP) ..... JP2019-178034

(51) Int. Cl.
*B41J 2/045* (2006.01)
*B41J 2/14* (2006.01)

(52) U.S. Cl.
CPC ..... *B41J 2/04563* (2013.01); *B41J 2/0451* (2013.01); *B41J 2/04541* (2013.01); *B41J 2/04543* (2013.01); *B41J 2/14153* (2013.01); *B41J 2002/14185* (2013.01)

(58) Field of Classification Search
CPC .. B41J 2/04563; B41J 2/0451; B41J 2/04541; B41J 2/04543; B41J 2/14153; B41J 2002/14185
See application file for complete search history.

(56) References Cited

U.S. PATENT DOCUMENTS

| | | | | |
|---|---|---|---|---|
| 9,033,442 | B2 * | 5/2015 | Kanno | B41J 2/0451 347/11 |
| 10,308,021 | B2 * | 6/2019 | Nomura | B41J 2/04541 |
| 2005/0110819 | A1 | 5/2005 | Kim et al. | |
| 2012/0306953 | A1 | 12/2012 | Kanno et al. | |
| 2018/0086057 | A1 | 3/2018 | Umeda | |
| 2018/0170051 | A1 | 6/2018 | Nomura et al. | |

FOREIGN PATENT DOCUMENTS

| | | | |
|---|---|---|---|
| CN | 101203385 | A | 6/2008 |
| CN | 101346234 | A | 1/2009 |
| CN | 104044371 | A | 9/2014 |
| CN | 107867072 | A | 4/2018 |
| JP | 2012-250511 | A | 12/2012 |

* cited by examiner

*Primary Examiner* — Geoffrey S Mruk
(74) *Attorney, Agent, or Firm* — Canon U.S.A., Inc. IP Division

(57) ABSTRACT

A printing apparatus comprising a printing element substrate, including a substrate including a heating element for heating and discharging liquid and a temperature detecting element for detecting a temperature of the substrate, wherein a detection period, during which a detecting result is obtainable, extends across a plurality of cycles of a latch signal, and a heating enabling signal for discharging the liquid and the latch signal are output such that, in the detection period, an output value of a temperature waveform does not exceed a preset threshold value, the temperature waveform being a temperature waveform of the substrate detected by the temperature detecting element.

12 Claims, 12 Drawing Sheets

LIQUID DISCHARGING HEAD

BACKGROUND

Field of the Disclosure

The present disclosure relates to a liquid discharging head.

Description of the Related Art

A printing apparatus, such as an inkjet printer, includes a liquid discharging head that discharges liquid, and prints an image and the like using the discharged liquid. The liquid discharging head includes discharging openings from which the liquid is discharged, and heating elements that heat the liquid to discharge the liquid from the discharging openings to print the image and the like on a printing medium. In such a liquid discharging head, for example, the liquid inconveniently stuck near a discharging opening or air bubbles undesirably mixed inside the discharging opening may cause a difficulty in discharging liquid in the discharging opening (hereinafter referred to as a discharge difficult discharging opening). The difficulty in discharging the liquid may affect the printing quality, and thus this situation is handled by using a discharging opening near the discharge difficult discharging opening to make up for the printing that otherwise should have been carried out by the discharge difficulty discharging opening in place thereof.

Under these circumstances, Japanese Patent Laid-Open No. 2012-250511 discusses a method in which a temperature detecting element is provided to each of the heating elements, thus detecting temperature information for each discharging opening and identifying the discharge difficult discharging opening. The identifying of the discharge difficult discharging opening enables the liquid discharging head to correctly make up for the printing to be carried out originally by the discharge difficult discharging opening in place thereof.

In Japanese Patent Laid-Open No. 2012-250511, a period for inspecting a temperature waveform, which is the temperature information acquired by the temperature detecting element, is contained within a block time during which the heating element is driven. On the other hand, as the printing speed increases, the block time reduces according to the increase of the speed. However, even when the block time reduces, the period for inspecting the waveform, which is the temperature information obtained by the temperature detecting element, is not changed without reducing, and thus ends up extending across a plurality of block cycles. When the inspection period extends across the plurality of block cycles, due to simultaneous operations of logic circuits according to a rise of a latch signal that occurs per block cycle, an inrush current flows to a ground wiring and a voltage drop is caused by wiring resistance. Noise generated therefrom may be superimposed on the obtained temperature waveform and hinder accurate determination as to whether the discharging opening is the discharge difficult discharging opening, leading to an incorrect determination.

SUMMARY

Embodiments of the present disclosure are directed to providing a liquid discharging head capable of making a correct determination as to whether the discharging opening is the discharge difficult discharging opening even in a case where the inspection period of the temperature detecting element extends across periods corresponding to a plurality of blocks.

Embodiments of the present disclosure provide a printing apparatus, comprising a printing element substrate, including a heating element configured to heat liquid to discharge the liquid from a discharging opening, a substrate including the heating element, and a temperature detecting element configured to detect a temperature of the substrate, wherein a detection period, during which a result of detecting the temperature of the substrate by the temperature detecting element is obtainable, extends across a plurality of cycles of a latch signal periodically input to the printing element substrate, and wherein a heating enabling signal, to be applied to the heating element, for discharging the liquid and the latch signal are output in such a manner that, in the detection period, an output value of a temperature waveform at a portion on which noise generated due to driving of a logic circuit of the printing element substrate based on the latch signal is superimposed does not exceed a preset threshold value, the temperature waveform being a temperature waveform of the substrate detected by the temperature detecting element.

Further features of the present disclosure will become apparent from the following description of exemplary embodiments with reference to the attached drawings.

DESCRIPTION OF THE EMBODIMENTS

Exemplary embodiments of the present disclosure will be described below with reference to the drawings.

Figure 1A:
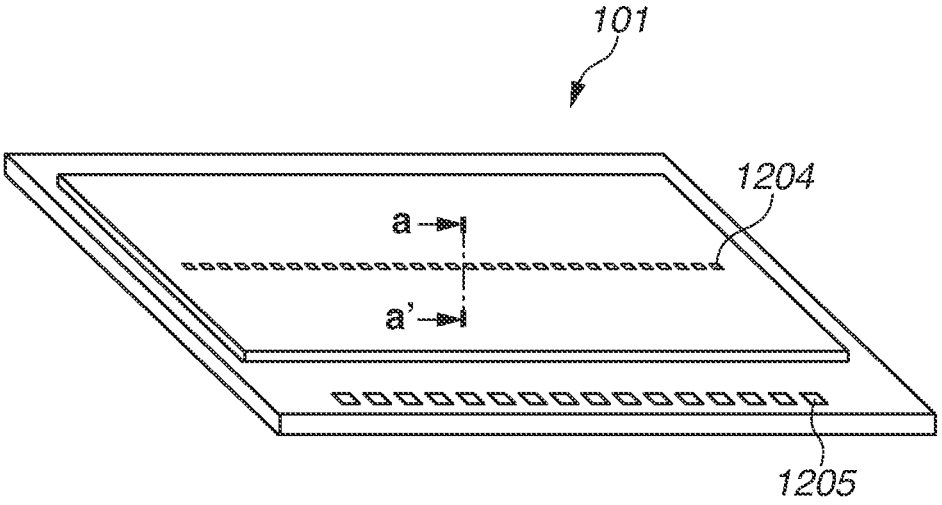
FIGS. 1A and 1B are schematic views each illustrating a printing element substrate.
Figure 1B:
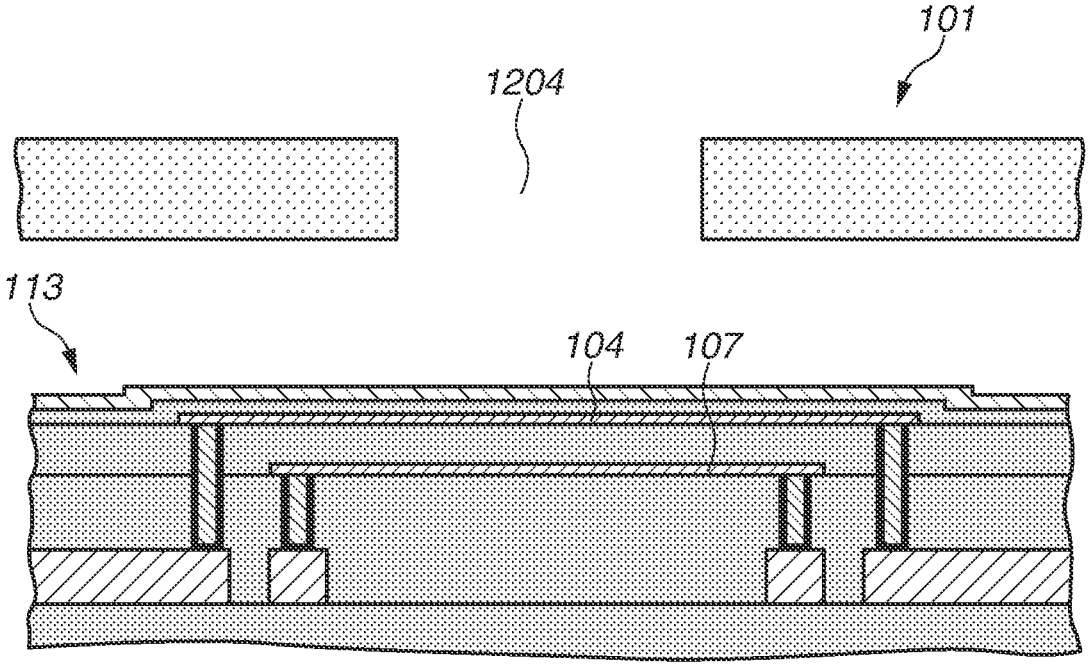
Figure 2:
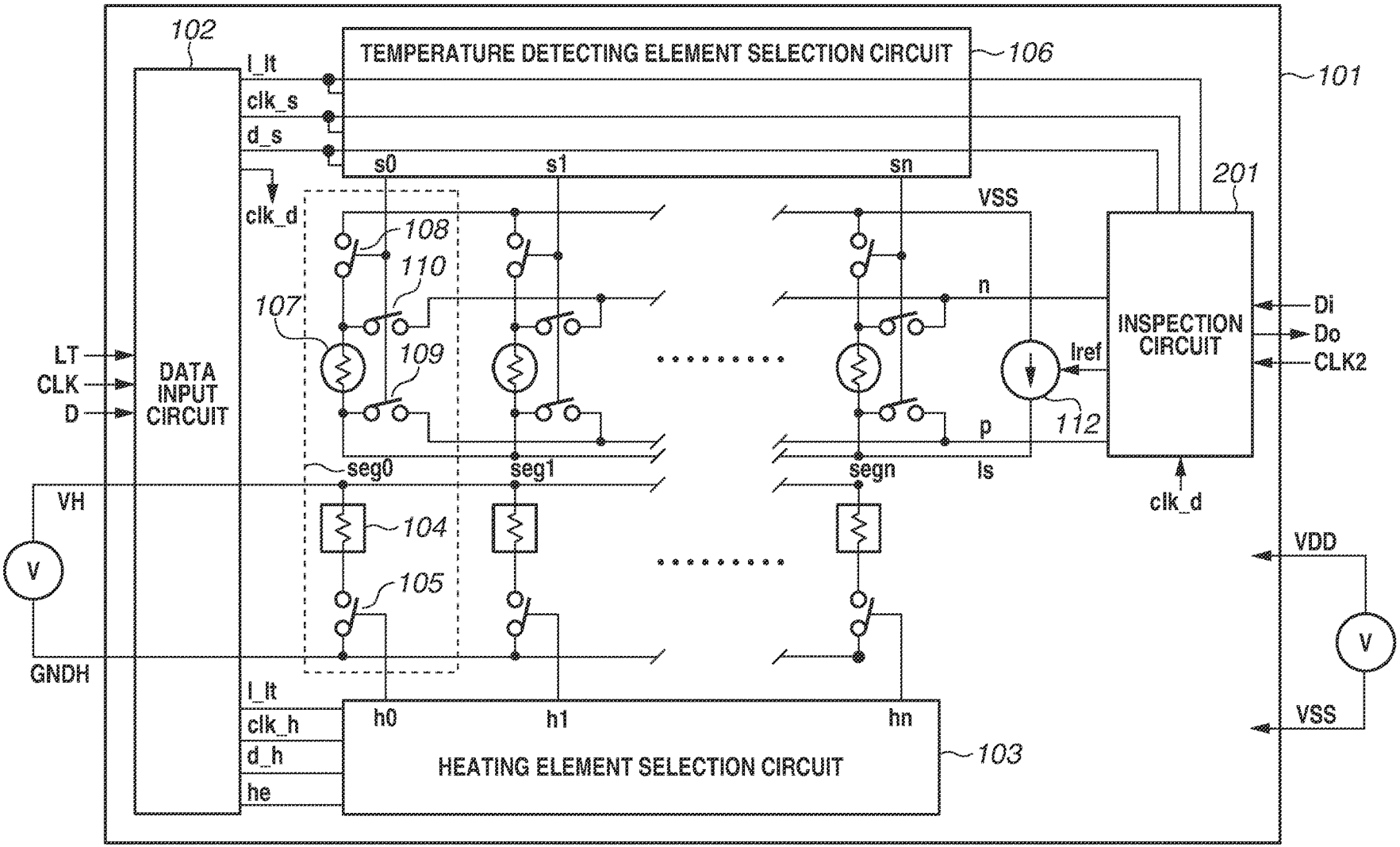
FIG. 2 is a schematic view illustrating a circuit configuration of the printing element substrate.

In the present disclosure, "LT" represents a latch signal transmitted to a data input circuit 102 (FIG. 2) disposed on a printing element substrate (FIGS. 1A and 1B). A symbol "CLK" represents a clock signal transmitted to the data input circuit 102 disposed on the printing element substrate. A symbol "D" represents a data signal transmitted in a serial format to the data input circuit 102 disposed on the printing element substrate, and the data signal D includes information about which heating element and temperature detecting element are selected among pluralities of heating elements and temperature detecting elements. The data signal D further includes information regarding a heating duration when the heating element heats liquid. A symbol "l_lt"

represents a latch signal that is generated by the data input circuit 102 based on "LT", and is transmitted to a heating element selection circuit 103 (FIG. 2) and a temperature detecting element selection circuit 106 (FIG. 2). A symbol "clk_h" represents a clock signal that is generated by the data input circuit 102 based on "CLK", and is transmitted to the heating element selection circuit 103. A symbol "d_h" represents a data signal that is generated by the data input circuit 102 based on "D", and is transmitted to the heating element selection circuit 103. A symbol "clk_s" represents a clock signal that is generated by the data input circuit 102 based on "CLK", and is transmitted to the temperature detecting element selection circuit 106 (FIG. 2). A symbol "d_s" represents a data signal generated by the data input circuit 102 based on "D", and is transmitted to the temperature detecting element selection circuit 106. A symbol "he" represents a heating enabling signal that is generated by the data input circuit 102 based on "D", and is input to a heating element 104 (FIG. 2). A term "block" refers to a group of a plurality of heating elements targeted for driving simultaneously when a plurality of heating elements 104 is driven in a time-division manner.

(Control Device and Printing Element Substrate)

Figure 12:
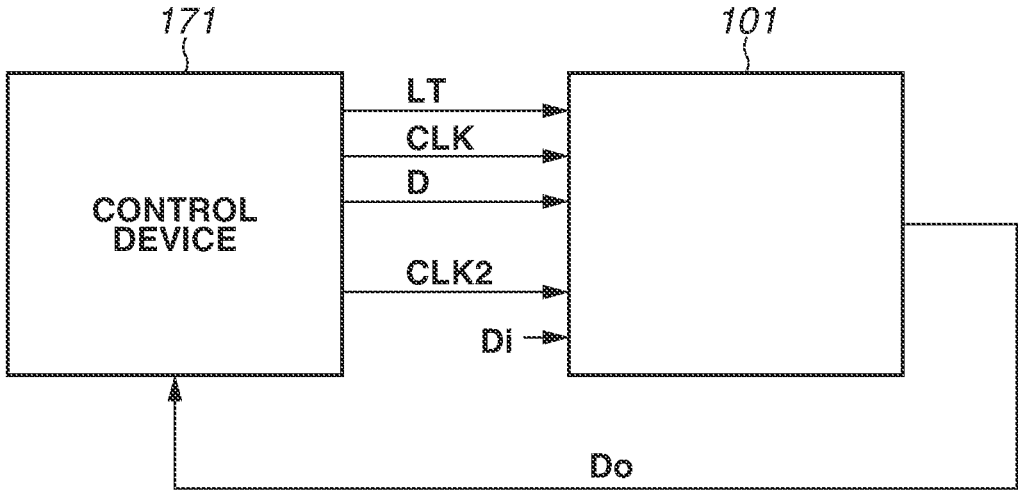
FIG. 12 is a connection diagram of the printing element substrate.

FIG. 12 illustrates a connection diagram of signals between a control device 171 and a printing element substrate 101. The control device generates printing control and printing information and information for controlling a discharge inspection. Signal lines are connected for a block signal LT, which measures a block time of time-division driving, a transfer clock signal CLK, a serial data signal D indicating control information, a serial data signal Do indicating determination data, and a transfer clock signal CLK2 of the serial data signal Do.

(Configuration of Printing Element Substrate)

The configuration of the printing element substrate 101 will be described below with reference to FIGS. 1A and 1B. FIG. 1A is a perspective view illustrating the printing element substrate 101. FIG. 1B is a schematic view in cross section taken along a line a-a' illustrated in FIG. 1A.

Discharging openings 1204 from which the liquid is discharged, terminals 1205 electrically connected to the outside (for example, a control board of a printing apparatus), and a substrate 113 including the heating elements 104 for heating the liquid to discharge the liquid are formed on the printing element substrate 101. The terminals 1205 include reception terminals that individually receive, for example, the clock signal, the data signal, and the latch signal, which will be described below, a transmission terminal that outputs a signal such as a determination result signal to the outside, a plurality of power source terminals, a plurality of ground terminals, and the like. The terminals 1205 supply energy, required to discharge the liquid, from the outside to the heating elements 104. As illustrated in FIG. 1B, the printing element substrate 101 is configured in such a manner that the heating element 104 is formed immediately below the discharging opening 1204, and a temperature detecting element 107 is formed immediately below this heating element 104.

(Circuit of Printing Element Substrate)

An electric circuit disposed on the printing element substrate 101 will be described below with reference to FIG. 2. FIG. 2 is a schematic view illustrating a circuit disposed on the printing element substrate 101. In FIG. 2, the plurality of heating elements 104 is arranged so as to be lined up in a predetermined direction. In the present example, FIG. 2 illustrates the heating elements 104 and the temperature detecting elements 107 corresponding to one column for simplification of the description.

As illustrated in FIG. 2, the printing element substrate 101 mainly includes the data input circuit 102, the heating element selection circuit 103, the temperature detecting element selection circuit 106, an inspection circuit 201, the heating elements 104, and the temperature detecting elements 107. A broken line in FIG. 2 indicates a segment 0 (seg0). This segment indicates that the temperature detecting element 107 is arranged in correspondence with the heating element 104. The state that the liquid is discharged due to the driving of the heating element 104 in the segment is detected by the temperature detecting element 107 in the same segment. The other segments (seg1, . . . segn) are similarly arranged.

The data input circuit 102 receives the latch signal LT, the clock signal CLK, and the data signal D transmitted from the outside. The data input circuit 102 then generates the latch signal l_lt, the clock signal clk_h for printing, the clock signal clk_s for the temperature detection, a clock signal clk_d for data processing, the data signal d_h for printing, the data signal d_s for the temperature detection, and the heating enabling signal he.

The heating element selection circuit 103 selects a specific heating element 104 among the plurality of heating elements 104 based on the latch signal l_lt, the clock signal clk_h, the data signal d_h, and the heating enabling signal he transmitted from the data input circuit 102. The heating element selection circuit 103 then drives the selected heating element 104. This heating element selection circuit 103 switches the heating element 104 to be driven according to a block cycle (described below), thus driving the heating elements 104 in the time-division manner. This driving will be briefly described now. The heating elements 104 in seg0, seg8, and seg16 are assigned to a block 1, and the heating elements 104 in seg1, seg9, and seg17 are assigned to a block 2. The heating elements 104 in the other segments are also similarly assigned. The assigned heating elements 104 are driven periodically block by block. A block time is determined for this driving, and the block to be driven is switched each time the latch signal is received.

The temperature detecting element selection circuit 106 selects a specific temperature detecting element 107 among the plurality of temperature detecting elements 107 based on the latch signal l_lt, the clock signal clk_s, and the data signal d_s transmitted from the data input circuit 102. The temperature detecting element selection circuit 106 then drives the selected temperature detecting element 107. The inspection circuit 201 inspects the discharging opening for difficulty in discharging based on the information acquired by the temperature detecting element 107. This temperature detecting element selection circuit 106 enables the temperature detecting elements 107 to detect the temperature in each two block cycle of a detection process.

The data signal D includes the not-illustrated externally generated printing control information, printing information, and information for controlling the discharge inspection, and is input to the data input circuit 102 according to the latch signal LT and the transfer clock signal CLK, which define the cycle of the data reception. Whether or not the information in the data signal D includes information indicating an instruction to drive the temperature detecting element 107 is determined based on whether predetermined identification information is included in the data signal D.

The data input circuit 102 expands the received latch signal LT, transfer clock signal CLK, and data signal D, and outputs l_lt, clk_s, and d_s to the temperature detecting element selection circuit 106. The data input circuit 102 expands the received block signal LT, transfer clock signal CLK, and data signal D, and outputs l_lt, clk_h, d_h, and he to the heating element selection circuit 103. The signal l_lt is the latch signal for the internal circuit that is generated with a predetermined pulse width at a timing of the rear edge of the latch signal LT. The signals clk_s and clk_h are the transfer clock signals. The signal d_s is the data signal for selecting the temperature detecting element 107 to be driven. The signal d_h is the data signal for selecting the heating element 104 to be driven. The signal he is an application signal for driving the heating element 104.

The heating element selection circuit 103 mainly includes a shift resister and a decoder, and drives the plurality of heating elements 104 in the time-division manner in response to receiving the latch signal l_lt, the clock signal clk_h, the data signal d_h, and the heating enabling signal he from the data input circuit 102. One terminal and the other terminal of the heating element 104 in seg0 are connected to a power source line VH and a driving switch 105, respectively. The other terminal of the driving switch 105 is connected to a GNDH line, to which the power source line VH returns. The power source line VH and the GNDH line are each connected to the terminal 1205. The driving switch 105 connected to the heating element 104 in seg0 is connected to a selection signal h0 of the heating element selection circuit 103, and is controlled to be switched on/off. The line connections of the other segments seg are also set up in a manner similar to seg0. Thus, a specific driving switch 105, among the plurality of disposed driving switches 105, is switched on by the heating element selection circuit 103 that has received the data signal d_h, and the selected heating element 104 connected to the specific driving switch 105 is driven. The liquid is discharged from the discharging opening corresponding to the driven heating element 104. Further, the data input circuit 102 includes each of a shift register (not illustrated) and a latch circuit (not illustrated) that receive the signals from the outside. The latch circuit periodically receives the latch signal l_lt, and stores information imported into the shift register.

The temperature detecting element 107 is disposed in the electric circuit of the printing element substrate 101 in such a manner that one terminal thereof is connected to wiring of a constant current power source 112, which supplies power to the temperature detecting element 107, and the other terminal is connected to a selection switch 108, which selects the temperature detecting element 107. The other terminal of the selection switch 108 is connected to vss wiring (ground wiring) to which a constant current Is returns. Further, both terminals of the temperature detecting element 107 are each connected to a different one of one terminal of a reading switches 109 and one terminal of a reading switches 110. The reading switches 109 and 110 are used for reading out terminal voltages. The other terminals of the reading switches 109 and 110 are connected to a pair of common wirings p and n. The selection switch 108 and the reading switches 109 and 110 are connected to a selection signal s0 of the temperature detecting element selection circuit 106, and are controlled to be switched on/off. The line connections of the other segments seg are also set up in a manner similar to seg0.

The inspection circuit 201 outputs the determination result signal Do indicating whether the discharging opening is the discharge difficult discharging opening to the outside based on the temperature information input via the pair of common wirings p and n. Common ground wiring is used for ground wirings of logic circuits and the ground wiring connected to the temperature detecting element 107. This configuration makes noise due to simultaneous operations of the logic circuits prone to generate on the temperature waveform detected by the temperature detecting element 107, as will be described in detail below. The logic circuits refer to, for example, the shift register (not illustrated) and the latch circuit (not illustrated) provided inside the heating element selection circuit 103.

(Inspection Circuit)

Figure 3:
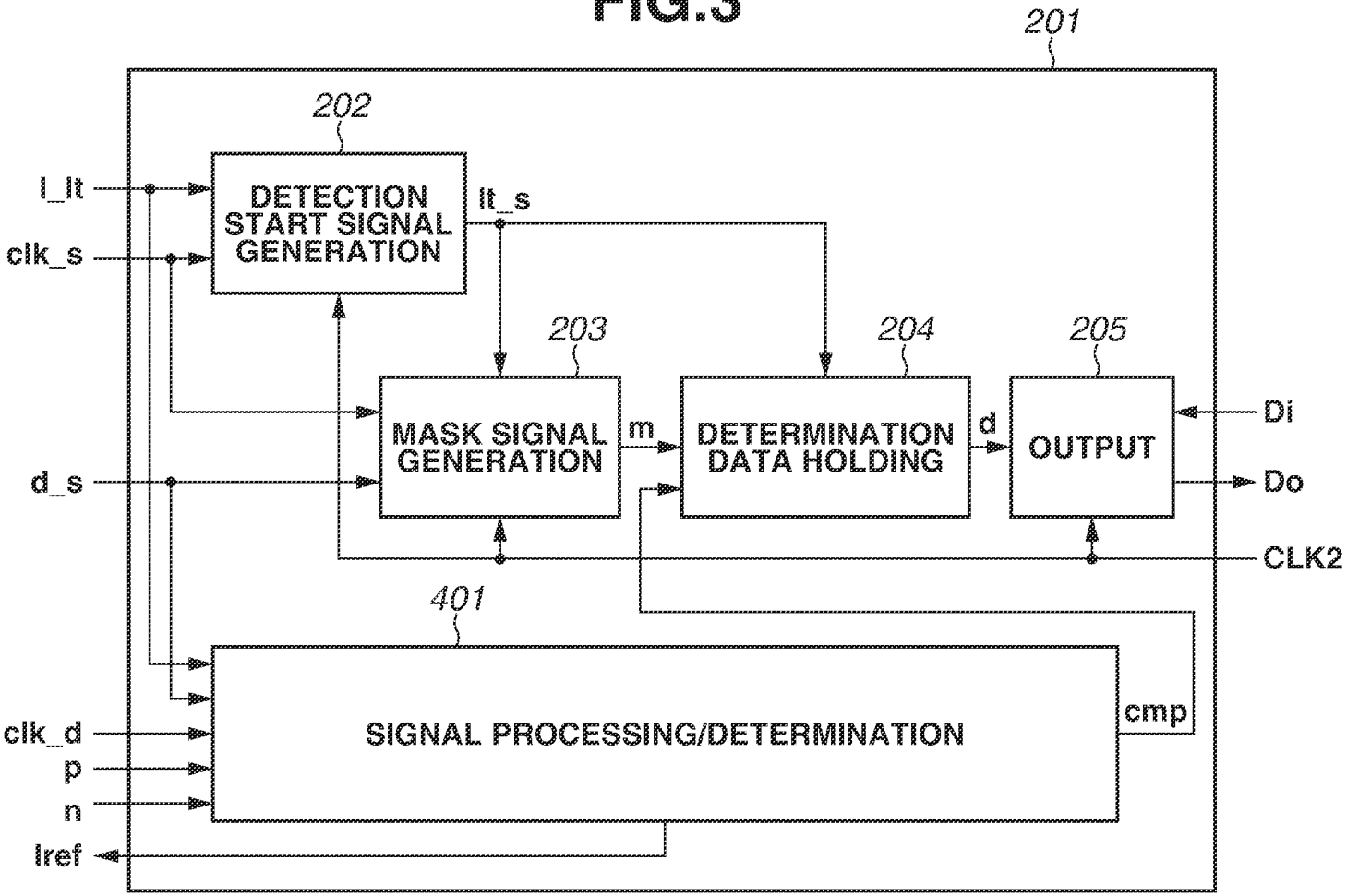
FIG. 3 is a block diagram of an inspection circuit.

The inspection circuit 201 will be described with reference to FIG. 3, which is a block diagram of the inspection circuit 201.

A detection start signal generation unit 202 receives the latch signal l_lt and the clock signal clk_s from the data input circuit 102, and generates a detection start signal lt_s. The detection start signal lt_s refers to a signal of a timing of starting measuring the temperature information of the substrate that the temperature detecting element 107 measures. The detection start signal generation unit 202 receives the clock signal CLK2 from the outside, but this is a clock signal for outputting the data indicating the determination about the result of the analysis.

A mask signal generation unit 203 receives the clock signal clk_s from the data input circuit 102 and receives the detection start signal lt_s from the detection start signal generation unit 202, and generates a mask signal m having a predetermined duration.

A signal processing/determination unit 401 performs processing for determining whether the discharge opening currently being detected using the temperature detecting element 107 is the discharge difficult discharging opening based on the temperature information (the temperature waveform) that is measured by the temperature detecting element 107 and is input via the wirings p and n. If the discharging opening currently being detected is the discharge difficult discharging opening, the signal processing/determination unit 401 outputs a binarized signal cmp to a determination data holding unit 204.

The determination data holding unit 204 converts the binarized signal cmp into the signal d based on the mask signal m from the mask signal generation unit 203, the detection start signal lt_s from the detection start signal generation unit 202, and the binarized signal cmp from the signal processing/determination unit 401. The determination data holding unit 204 then outputs the signal d to an output unit 205.

The output unit 205 converts the signal d into the output signal (the determination result signal) Do based on the clock signal CLK2 from the outside, and outputs it to the outside.

(Signal Processing/Determination Unit)

Figure 4:
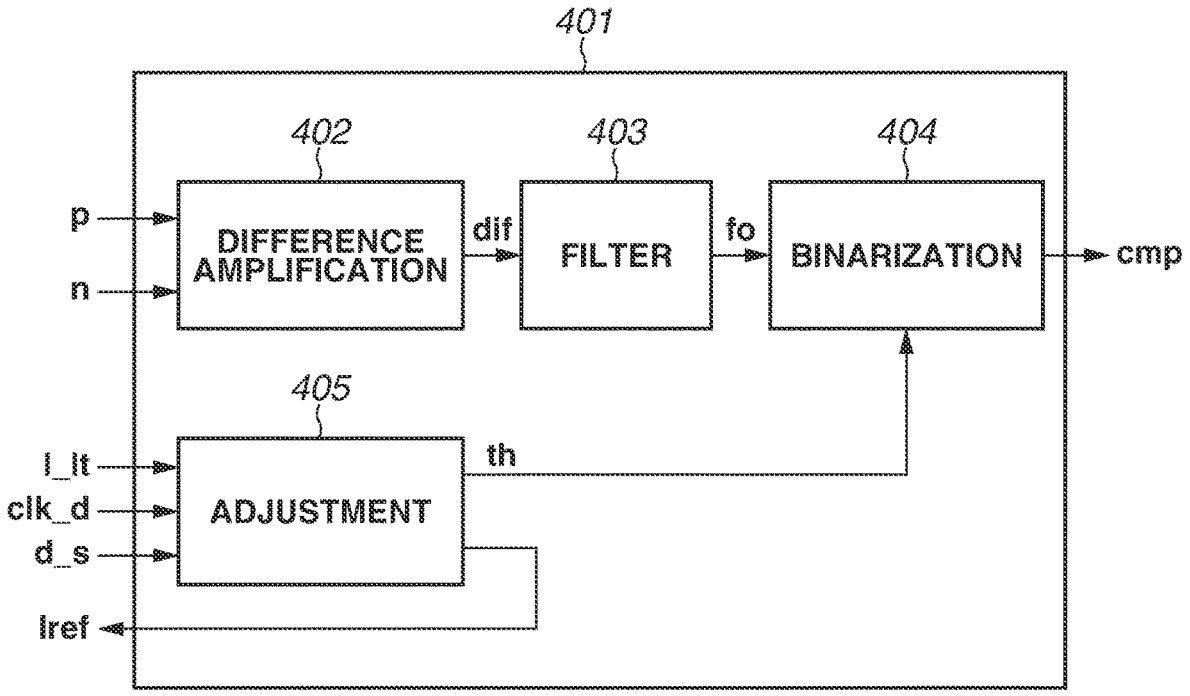
FIG. 4 is a block diagram of a signal processing/determination unit.

The signal processing/determination unit 401 will be described with reference to FIG. 4, which is a block diagram of the signal processing/determination unit 401.

Figure 5:
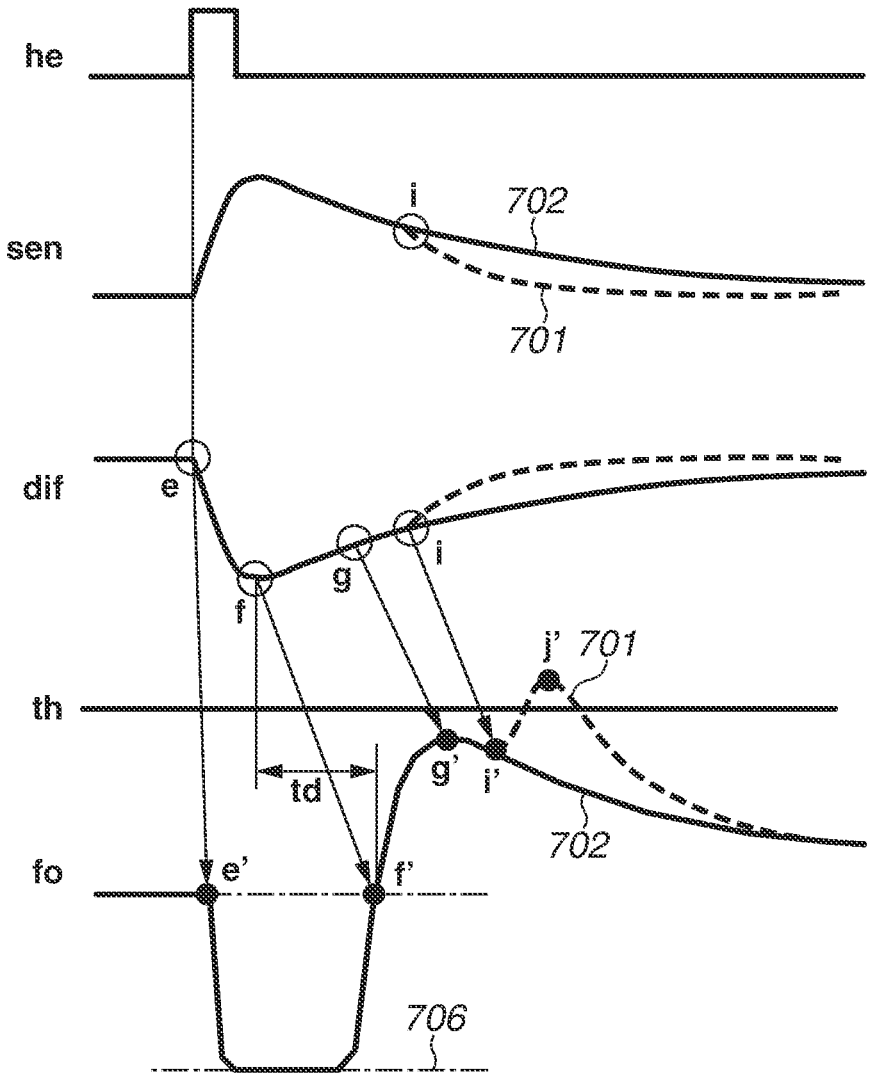
FIG. 5 is a schematic view of temperature waveforms.

As described above, the signal processing/determination unit 401 is a circuit that outputs the binarized signal cmp. First, a difference amplification circuit 402 amplifies voltages at both ends of the temperature detecting element 107 that are acquired via the wirings p and n as a difference output dif, and outputs the difference output dif to a filter circuit 403. After that, the filter circuit 403 performs processing such as differentiation on the difference output dif, and outputs a result thereof to a binarization unit 404 as a filter output fo. The filter circuit 403 includes a bandpass filter configured to be sensitive to a feature point i (FIG. 5)

that appears on the temperature waveform of the substrate when the liquid can be normally discharged from the discharging opening.

The binarization unit 404 includes a comparator, and compares the filter output fo with a preset threshold value th fed from an adjustment unit 405 and generates the binarized signal cmp. As will be described in detail below, the threshold value th serves as, for example, a criterion for determining whether the liquid can be normally discharged from the discharging opening currently being detected.

The adjustment unit 405 includes a digital-analog (DA) converter that generates a reference current Iref to be input to the constant current power source 112, and a DA converter that generates the threshold value th to be input to the binarization unit 404. The value of each of the DA converters is set based on the latch signal l_lt, the clock signal clk_s, and the data signal d_s.

(Temperature Waveform)

The temperature waveform of the substrate will be described with reference to FIG. 5. FIG. 5 is a schematic view illustrating temperature waveforms of the substrate that the temperature detecting element 107 can measure. In FIG. 5, a solid line 702 indicates a waveform obtained in a case where the liquid is not normally discharged and a broken line 701 indicates a waveform acquired in a case where the liquid is normally discharged. When the heating enabling signal he is applied to the heating element 104, the heating element 104 is driven and a temperature waveform like a waveform sen can be obtained. When the driving of the heating element 104 is ended, the temperature of the substrate gradually reduces. If the discharging opening targeted for the detection is the discharge difficult discharging opening, the waveform of the temperature exhibits a continuous gradual reduction in the course of the temperature reduction of the temperature waveform. On the other hand, if the discharging opening targeted for the detection is not the discharge difficult discharging opening, i.e., a discharging opening from which the liquid is normally discharged, the temperature waveform exhibits a different behavior from the behavior of the temperature waveform at the discharge difficult discharging opening from a certain point i. This certain point i refers to the feature point. In a case where the liquid is normally discharged, the temperature waveform exhibits a greater reduction than the temperature reduction obtained at the discharge difficult discharging opening from the feature point i.

A cause for this phenomenon of great temperature reduction is considered to be that the rear edge of a liquid droplet discharged from the discharging opening contacts the surface of the printing element substrate 101 and the substrate is cooled down thereby. This phenomenon is employed as a criterion for determining whether the liquid is normally discharged from the discharging opening.

A waveform dif (the difference output dif) is obtained by inverting the waveform sen. A waveform fo (the filter output fo) is obtained by differentiating the difference output dif once. As indicated by the filter output fo, differentiating the difference output dif once can make a further noticeable difference between the behaviors of the two waveforms from the feature point i. The filter output fo is clipped at a vss voltage 706 and thus a lower limit voltage thereof is placed at the ground level.

Each point (f', g', and i') of the filter output fo appears on the waveform at a timing delayed from each point (f, g, and i) of the difference output dif. This is because a delay time td occurs due to the execution of the differential processing. The f point and the f point are points at which the measured temperature of the substrate is maximized, i.e., correspond to a timing of ending applying the voltage to the heating element 104. In other words, the f point and the f point are a timing of ending the driving of the heating element 104. The g point and the g' point are points at which the change speed is maximized in the course of the temperature reduction (hereinafter referred to as a temperature reduction fastest point). In other words, the temperature reduction fastest point g refers to a time at which the change speed is maximized while the waveform is being converging after transitioning from the temperature increase to the temperature reduction. The temperature reduction fastest point g is determined according to the thickness (the thermal time constant) of an insulation film between the heating element 104 serving as the heat source and the temperature detecting element 107.

The discharging opening is determined to be a normal discharging opening if the filter output fo exceeds the threshold value th, and is determined to be the discharge difficult discharging opening if the filter output fo does not exceed the threshold value th. The threshold value th is set to a value between the maximum value g' of the filter output fo obtained in a case where the discharging opening currently being detected is the discharge difficult discharging opening, and a maximum value j' of the filter output fo obtained in a case where the liquid is normally discharged. Thus, the discharging opening currently being detected can be determined to be a discharging opening from which the liquid can be normally discharged in a case where the filter output fo exceeds the threshold value th, and can be determined to be the discharge difficult discharging opening in a case where the filter output fo does not exceed the threshold value th.

(Circuit Operation of Printing Element Substrate)

Figure 6:
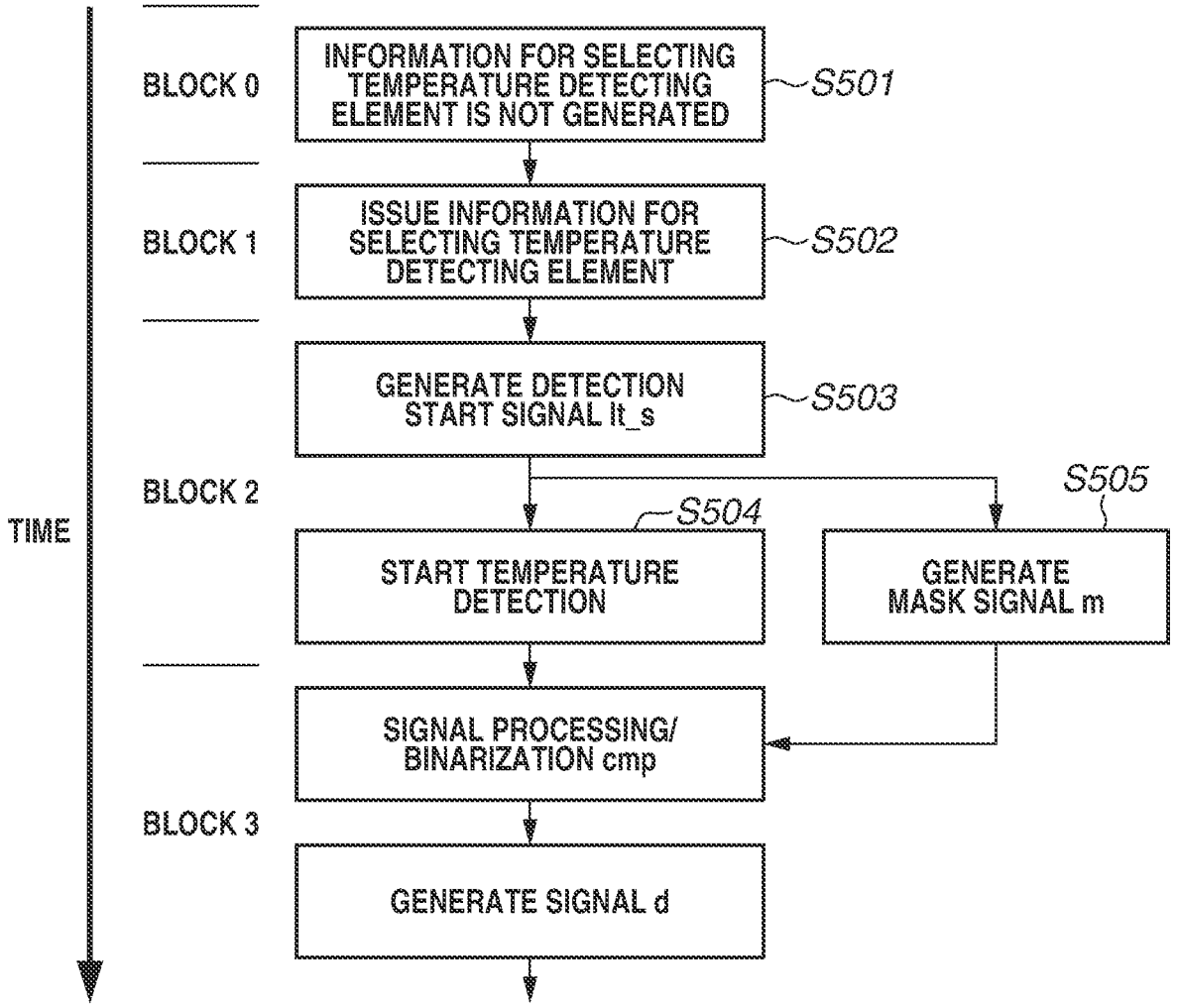
FIG. 6 is a flowchart of temperature detection.
Figure 7:
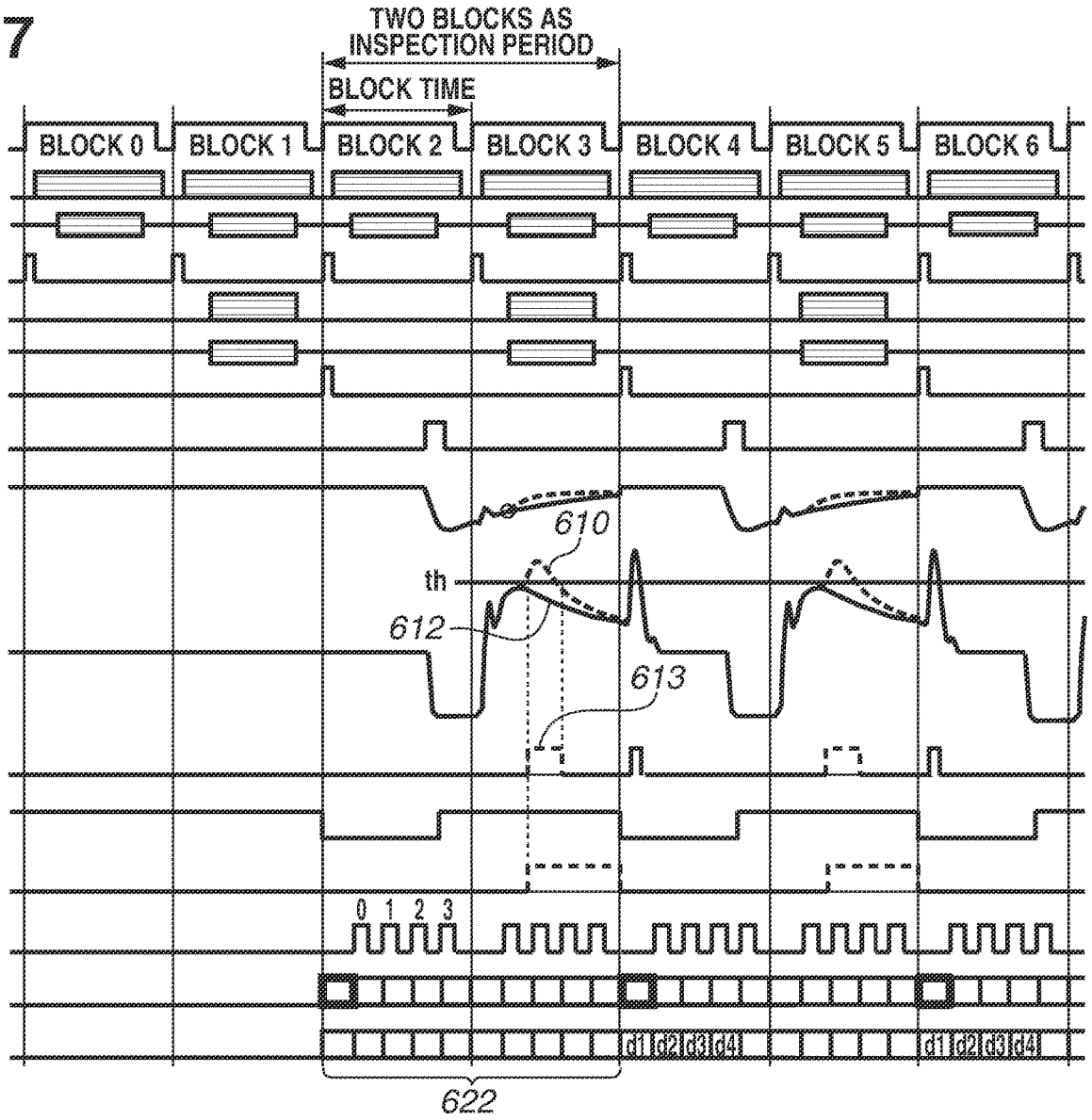
FIG. 7 is a timing chart corresponding to the flowchart illustrated in FIG. 6.

The above-described operation of inspecting the discharging opening of the circuit in the printing element substrate 101 will be described below with reference to FIGS. 6 and 7. FIG. 6 is a flowchart illustrating a series of operations from the start of the determination about whether the discharging opening is the discharge difficult discharging opening to the output of the determination result. FIG. 7 is a timing chart according to the flowchart illustrated in FIG. 6. Each of FIGS. 6 and 7 is presented in such a manner that block numbers illustrated in FIG. 6 and block numbers illustrated in FIG. 7 correspond to each other.

In a period 1, the transmission of various signals from the outside is started. This means that the various signals do not reach the temperature detecting element selection circuit 106 yet, and thus the information for selecting the temperature detecting element 107 to be used in the inspection (the clock signal clk_s and the data signal d_s) is not generated either as illustrated in FIG. 7 (step S501 in FIG. 6).

In a period 2, the information for selecting the temperature detecting element 107 (the clock signal clk_s and the data signal d_s) is generated by the data input circuit 102 as illustrated in FIG. 7 (step S502 in FIG. 6).

In a period 3, the latch signal l_lt, the clock signal clk_s, and the data signal d_s are input to the temperature detecting element selection circuit 106, and the detection start signal lt_s is also generated by the detection start signal generation unit 202 as illustrated in FIG. 7 (step S503 in FIG. 6). Thus, the detection of the temperature by the temperature detecting element 107 is started by being triggered at the timing when the detection start signal lt_s rises (step S504 in FIG. 6). In the period 3, the heating enabling signal he is input to the heating element 104, and the heating element 104 is driven. The temperature of the substrate of the printing element substrate 101 increases due to the driving of the heating element 104. Then, the difference output dif, which is obtained by inverting the temperature waveform, and the filter output fo, which is obtained by differentiating the difference output dif once, can be obtained. Further, the mask signal m is generated by the mask signal generation unit 203 (step S505 in FIG. 6). The determination data holding unit 204 does not obtain the temperature waveform in a case where the mask signal m is set to a low level and obtains the temperature waveform in a case where the mask signal m is set to a high level. Thus, in the detection period during which the temperature detecting element 107 can acquire the result of detecting the temperature of the substrate, the high-level mask signal m is output.

In a period 4, the feature point i appears. A broken line 610 indicates the temperature waveform obtained in a case where the liquid is normally discharged and a solid line 612 indicates the temperature waveform obtained in a case where the discharging opening is the discharge difficult discharging opening. A binarized signal 613 having a duration corresponding to the duration during which the filter output fo exceeds the threshold value th is generated in a case where the filter output fo exceeds the threshold value th, and no binarized signal is generated in a case where the filter output fo does not exceed the threshold value th. Thus, the presence or absence of the binarized signal is a result of the detection by the temperature detecting element 107. The threshold value th is set to a value between the peak voltage when the liquid is normally discharged and the peak voltage when the liquid is not discharged. The detection of the temperature is also ended along with the end of the period 4. More specifically, the timing at which the next detection start signal lt_s rises serves as a detection end signal for ending the detection of the temperature and triggers the end of the detection of the temperature, and also serves as the detection start signal for starting the detection directed to the next discharging opening (switches the discharging opening). In other words, the next heating element 104 is driven, and the next temperature detection is carried out by the corresponding temperature detecting element 107. In and after a period 5, the above-described cycle from the period 3 to the period 4 is repeated.

In the above-described manner, the driving of the heating element 104 in this operation of detecting the temperature is different from the driving during the printing operation, and one heating element 104 is driven among the plurality of heating elements 104 belonging to the block. Further, the timing of driving the heating element 104 is also different from the driving during the printing operation. One block cycle is set as a downtime after the driving, and the next selected heating element 104 is driven in the block cycle subsequent to this downtime.

As illustrated in FIG. 7, the detection period during which a result of detecting the temperature can be obtained extends across a plurality of cycles, each of which is the input cycle of the periodically input latch signal l_lt. More specifically, the detection period extends across two block cycles (two cycles), the period 3 and the period 4 in FIG. 7. Thus, the noise due to the simultaneous operations of the logic circuits is superimposed on the filter output fo between the period 3 and the period 4, erroneously leading to an output of a larger value than the value to be normally output. As a result, even for a case where the filter output fo is not to exceed the threshold value th, the superimposition of the noise may cause the filter output fo to erroneously exceed the threshold value th, thus causing the discharging opening that is the discharge difficult discharging opening to be undesirably incorrectly determined to be a normal discharging opening. In light of this, even when the noise due to the latch signal is undesirably superimposed on the filter output fo, the present exemplary embodiment can prevent the above-described incorrect determination from being made by performing control so as to prohibit this noise from being superimposed near the maximum value of the filter output fo. Data 622 of Di and Do in the blocks 2 and 3 indicates indefinite data.

(Latch Signal and Temperature Waveform)

Figure 8:
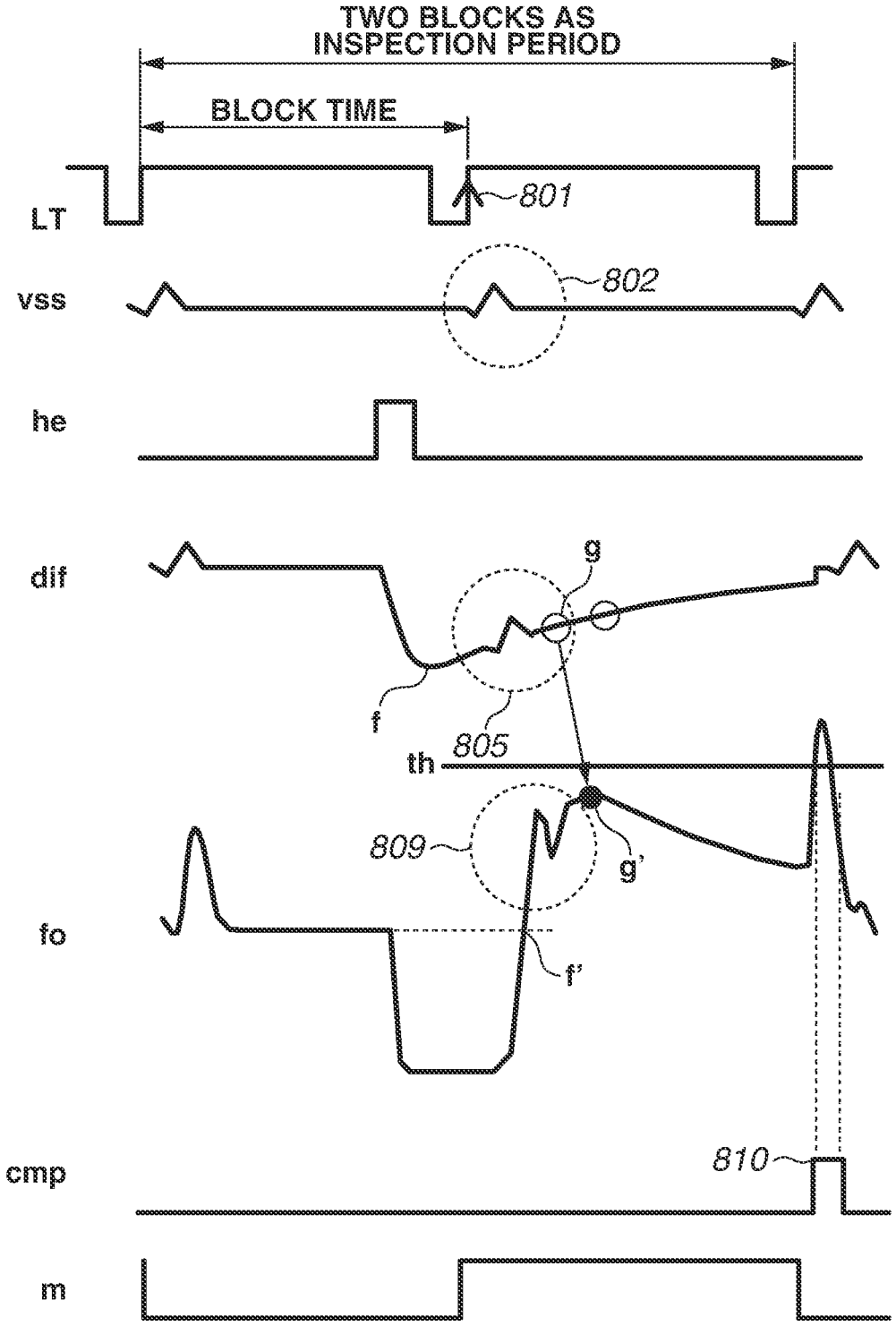
FIG. 8 is a timing chart of the temperature waveform.

The timing chart of the temperature waveform obtained in the present exemplary embodiment will be described with reference to FIG. 8. FIG. 8 is a schematic view illustrating the timing chart of each waveform obtained in the present exemplary embodiment, and indicates the waveform in a case where the discharging opening on which the temperature detection is being performed is the discharge difficult discharging opening.

Due to the simultaneous operations of the logic circuits based on a rise 801 of the latch signal LT, an inrush current flows to the vss wiring and a voltage drop is caused by wiring resistance. As a result, a voltage fluctuation (noise) 802 occurs on vss. Due to the superimposition of the noise 802 on vss, the temperature detecting element 107 and the inspection circuit 201 sharing the vss wiring are affected by the noise 802, and noise 805 also generates on the difference output dif (the inverted waveform) obtained by inverting the temperature waveform. Due to the generation of the noise 805 on the difference output dif, noise 809 is also generated on the filter output fo (the differential waveform) obtained by differentiating the difference output dif once.

The present exemplary embodiment adjusts the timing at which the latch signal LT rises and the timing of the heating enabling signal he, thus allowing the noise to be superimposed before the timing at which the maximum value of the filter output fo can be obtained as illustrated in FIG. 8. With this adjustment, even in a case where the noise is superimposed on the filter output fo, the output value does not exceed the threshold value th at the portion of the filter output fo on which the noise is superimposed within the period during which the temperature of the substrate is detected, so that the incorrect determination for the temperature detection can be prevented from being made. More specifically, the present exemplary embodiment makes the adjustment in such a manner that the rise of the latch signal LT is located between the minimum point f of the difference output di and the point f that corresponds to the minimum point f of the filter output fo. Thus, the noise also generates between the point f and the point f, which can further ensure that the incorrect determination is prevented from being made with respect to the temperature detection in a case where the noise is superimposed on the filter output fo.

A binarized signal 810 is generated due to the superimposition of the noise on the filter output fo so as to cause the filter output fo to exceed the threshold value th at the beginning of the next block, but this does not lead to the incorrect determination because this period is set to the period during which the binarized signal is not sensed using the mask signal m.

Second Exemplary Embodiment

Figure 9:
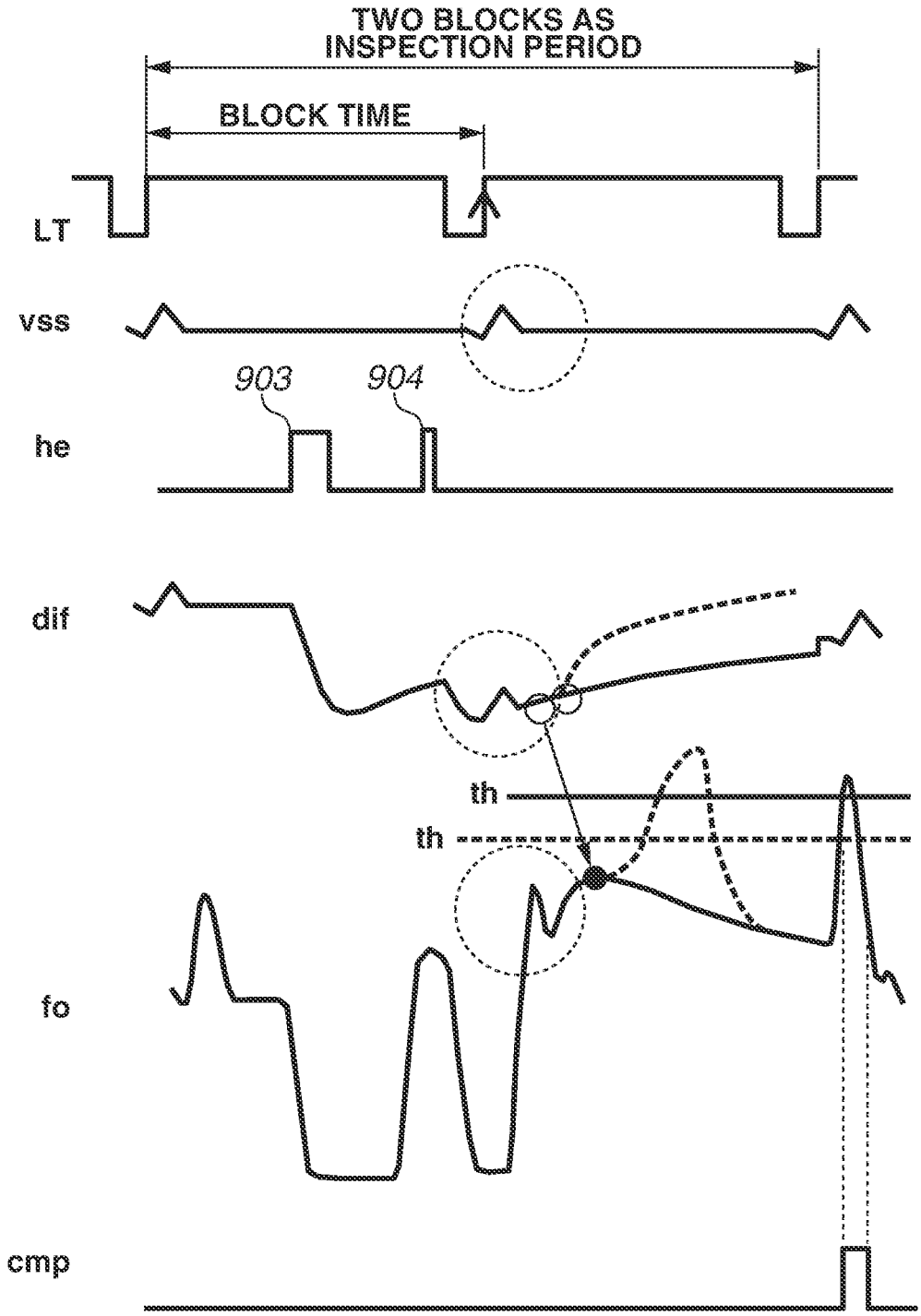
FIG. 9 is a schematic view illustrating a second exemplary embodiment.

A second exemplary embodiment will be described with reference to FIG. 9. The second exemplary embodiment will be described, assigning similar reference numerals to portions similar to the first exemplary embodiment and omitting the descriptions thereof. FIG. 9 is a schematic view illustrating various waveforms obtained in the present exemplary embodiment. A broken line and a solid line in FIG. 9 indicate the waveform acquired when the liquid is normally discharged and the waveform acquired when the discharging opening is the discharge difficult discharging opening, respectively. Further, the threshold value th indicated by a broken line corresponds to the value of the threshold value th according to the first exemplary embodiment. In the present exemplary embodiment a method will be described in which the discharge state is inspected by applying an application pulse for emphasizing the temperature change to the heating element 104, to make a further difference in behavior between the waveform obtained when the liquid is normally discharged and the waveform obtained when it is difficult to discharge the liquid.

The heating enabling signal he is applied in such a manner that, after first application 903 for causing the discharge is conducted, second application 904 adjusted so as not to cause foaming is conducted at a timing immediately before the feature point appears in the course of the temperature reduction of the temperature waveform. Thus, the substrate is cooled down by the liquid droplet after the temperature of the liquid first increases before the feature point appears, and therefore the waveform obtained when the liquid is normally discharged exhibits a further noticeable temperature change after the feature point appears. Accordingly, a larger value is output as the maximum value of the filter output fo obtained by differentiating this temperature waveform than the maximum value of the filter output fo according to the first exemplary embodiment. This allows the threshold value th to be set to a higher value, thus contributing to preventing the noise from exceeding the threshold value th even when the noise generates on the temperature waveform.

In this manner, the present exemplary embodiment can further reduce the possibility of undesirably making the incorrect determination due to the influence of the noise by applying the second application pulse 904. In the exemplary embodiments, the example has been described in which the period of the detection by the temperature detecting element 107 extends across the two blocks, but the present disclosure is not limited thereto. More specifically, embodiments of the present disclosure can be effectively employed even in a case where the detection period extends across any plurality of blocks. The timings of outputting the heating enabling signal he and the latch signal l_lt are adjusted in such a manner that the noise is generated before the timing at which the maximum value of the filter output fo can be acquired, but the present disclosure is not limited thereto. More specifically, the timings may be adjusted in such a manner that the noise due to the latch signal is generated after the timing at which the maximum value of the filter output fo can be acquired, as long as the temperature waveform affected by the noise does not exceed the threshold value th.

COMPARATIVE EXAMPLE

Figure 10:
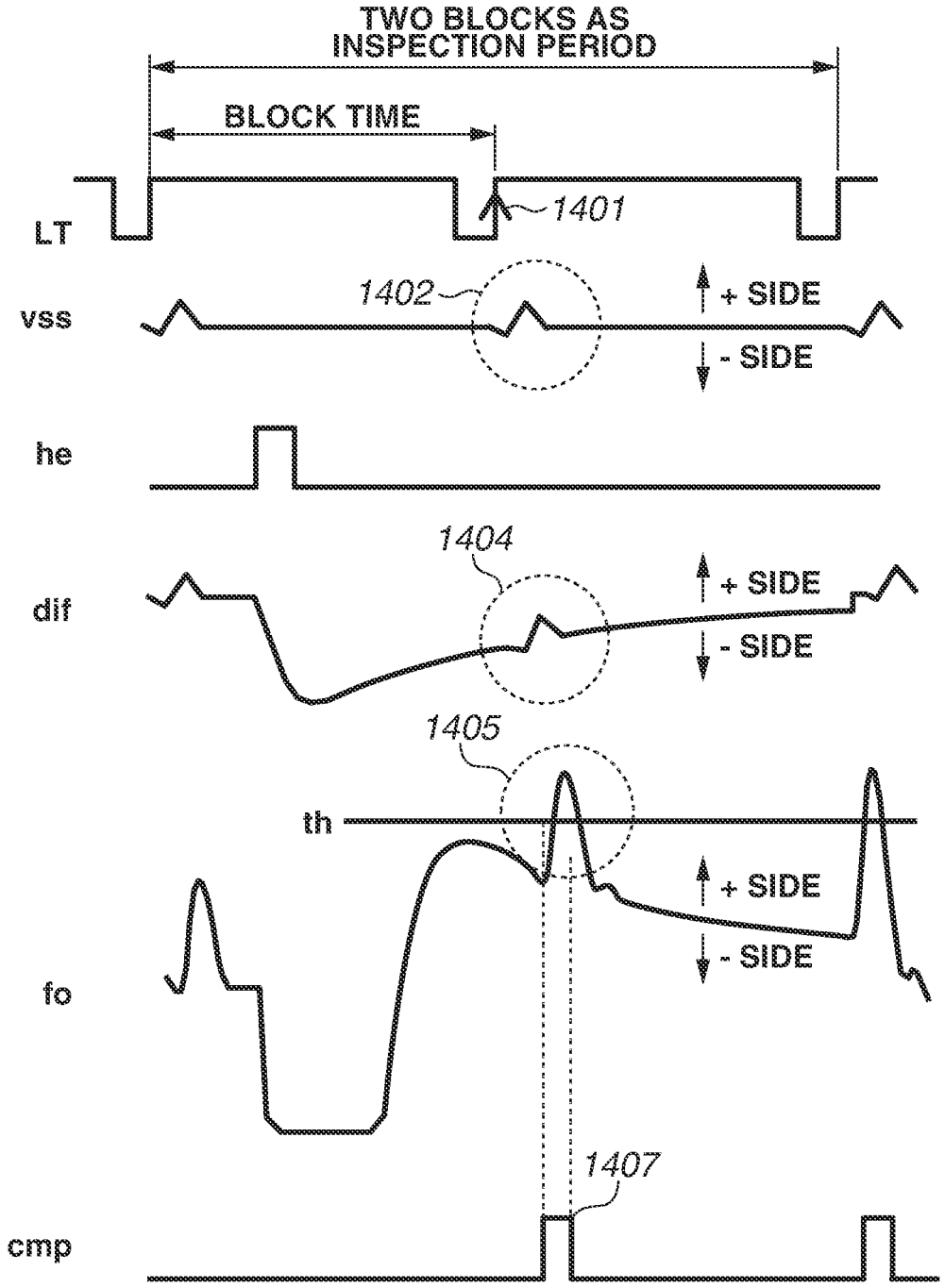
FIG. 10 is a schematic view illustrating a comparative example.
Figure 11:
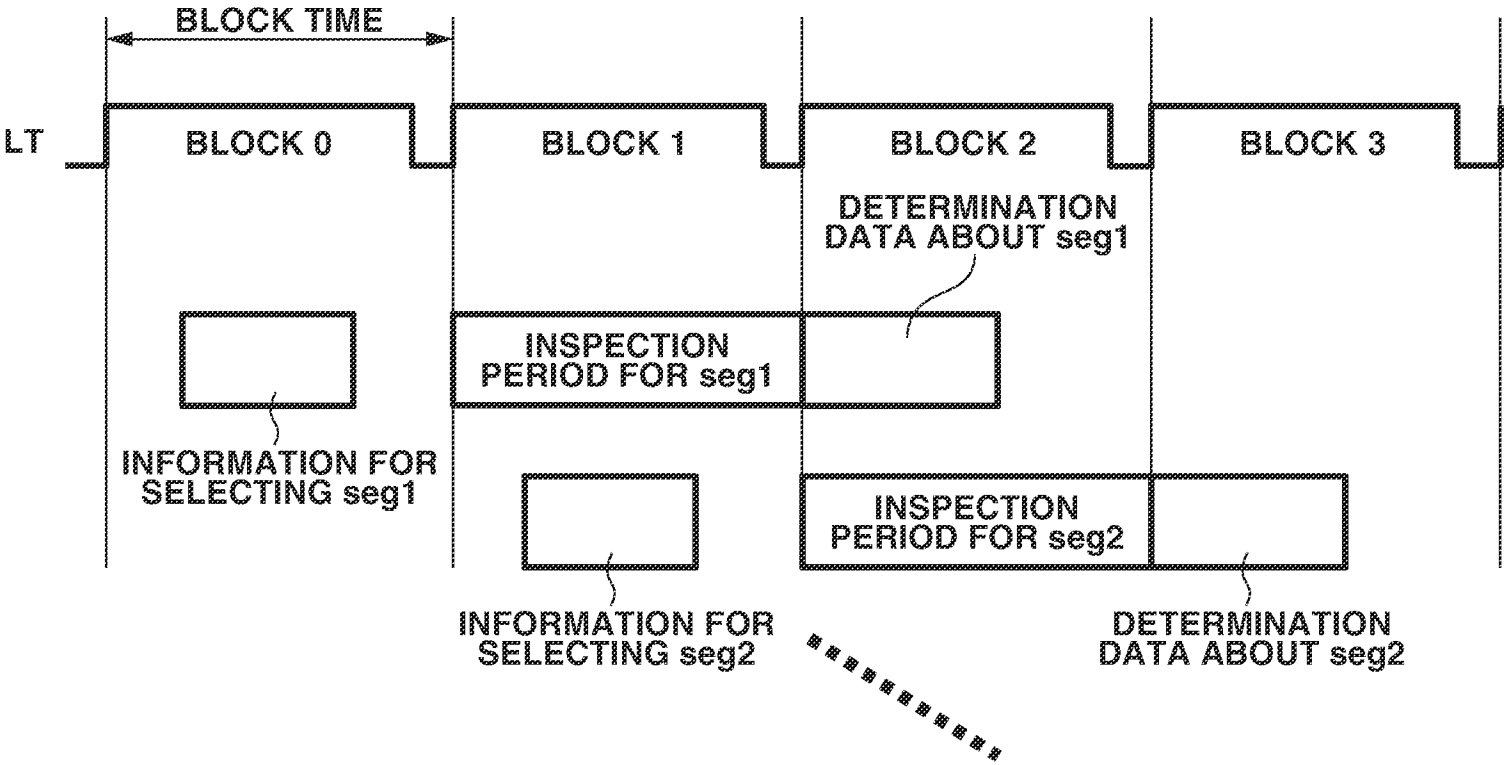
FIG. 11 is a schematic view illustrating the comparative example.

A comparative example of the exemplary embodiments of the present disclosure will be described with reference to FIGS. 10 and 11. FIG. 10 is a schematic view illustrating a timing chart of each waveform in the comparative example of the exemplary embodiments of the present disclosure, and indicates the waveform in a case where the discharging opening on which the temperature detection is being performed is the discharge difficult discharging opening. FIG. 11 illustrates a timing chart when the inspection is conducted within one block time. As illustrated in FIG. 11, the information for selecting a temperature detecting element seg1 is input in the block 1. The inspection of seg1 is conducted and the information for selecting a next temperature detecting element seg2 is also input in the block 2. The data indicating the determination for seg1 is output and the inspection of seg2 is also conducted in the block 3. After that, the inspection procedure is repeated in a similar manner.

Due to the simultaneous operations of the logic circuits according to a rise 1401 of the latch signal LT, an inrush current flows to the vss wiring and a voltage drop is caused by the wiring resistance. As a result, a voltage fluctuation (noise) 1402 occurs on vss. Due to the superimposition of the noise 1402 on vss, the temperature detecting element 107 and the inspection circuit 201 sharing the vss wiring are affected by the noise 1402, and noise 1404 also generates on the difference output dif obtained by inverting the temperature waveform. Due to the generation of the noise 1404 on the difference output dif, noise 1405 also generates on the filter output fo.

In FIG. 10, the noise 1405 generates in the state that the value of the filter output fo does not fully reduce yet. As a result, the filter output fo exceeds the threshold value th, which erroneously leads to generation of a binarized signal 1407 and thus undesirably causes the discharge difficult discharging opening to be incorrectly determined to be a normal discharging opening. The filter output fo when the liquid is normally discharged does not yield the incorrect determination because the filter output fo exceeds the threshold value th regardless of whether the noise is superimposed or not. However, the threshold value th should be set to an appropriate voltage between the peak voltage when the liquid is normally discharged and the peak voltage when the liquid cannot be discharged. Thus, if the peak voltage when the liquid is normally discharged is emphasized in response to the noise, this makes it difficult to set the appropriate determination threshold value th. The influence of the noise also becomes an issue from this viewpoint.

Therefore, in the exemplary embodiments of the present disclosure, the timing of outputting the heating enabling signal he and the timing of outputting the latch signal LT are adjusted in such a manner that the output generating on the waveform due to the latch signal of the latch circuit does not exceed the threshold value th, as described above. Due to this adjustment, the exemplary embodiments of the present disclosure can reduce the influence of the noise due to the latch signal when the inspection period extends across the plurality of blocks, thereby preventing the incorrect determination from being made.

While the present disclosure includes exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-178034, filed on Sep. 27, 2019, which is hereby incorporated by reference herein in its entirety.

What is claimed is:

1. A printing apparatus comprising:

a printing element substrate including a heating element configured to heat liquid to discharge the liquid from a discharging opening, a substrate including the heating element, and a temperature detecting element configured to detect a temperature of the substrate, wherein a detection period, during which a result of detecting the temperature of the substrate by the temperature detecting element is obtainable, extends across a plurality of cycles of a latch signal periodically input to the printing element substrate, wherein a heating enabling signal, to be applied to the heating element, for discharging the liquid and the latch signal are output in such a manner that, in the detection period, an output value of a temperature waveform at a portion on which noise generated due to driving of a logic circuit of the printing element substrate based on the latch signal is superimposed does not exceed a preset threshold value, the temperature waveform being a temperature waveform of the substrate detected by the temperature detecting element, wherein the printing element substrate includes a mask signal generation unit configured to generate a mask signal, and wherein the detection period is a period during which the mask signal is output at a high level.

2. The printing apparatus according to claim 1, wherein the latch signal is output before a timing at which a maximum value of a differential waveform appears, the differential waveform being obtained by differential processing being performed on an inverted waveform formed by inversion of the temperature waveform of the substrate detected by the temperature detecting element.

3. The printing apparatus according to claim 1, wherein the latch signal is output after a timing at which a maximum value of a differential waveform appears, the differential waveform being obtained by differential processing being performed on an inverted waveform formed by inversion of the temperature waveform of the substrate detected by the temperature detecting element.

4. The printing apparatus according to claim 1, wherein the latch signal is output between a timing at which applying of the heating enabling signal to the heating element is end and a timing corresponding to a timing at which applying of the heating enabling signal is end on the differential waveform obtained by the differential processing being performed on the temperature waveform.

5. The printing apparatus according to claim 1, wherein a voltage not causing the discharge of the liquid from the discharging opening is applied to the heating element after the heating enabling signal is applied.

6. The printing apparatus according to claim 1, wherein the detection period extends across two cycles of the periodically input latch signal.

7. The printing apparatus according to claim 1, wherein the temperature detecting element is disposed immediately below the heating element.

8. The printing apparatus according to claim 1, wherein the threshold value is a threshold value serving as a criterion for determining whether the liquid can be normally discharged from the discharging opening being detected by the temperature detecting element.

9. The printing apparatus according to claim 1, wherein the latch signal is a latch signal defining a timing of driving the heating element.

10. The printing apparatus according to claim 1, wherein the latch signal is a latch signal defining a timing of driving the temperature detecting element.

11. The printing apparatus according to claim 1, wherein the latch signal is a latch signal defining timings of driving the heating element and the temperature detecting element.

12. The printing apparatus according to claim 1, wherein a common wiring is used for a ground wiring of the logic circuit and a ground wiring connected to the temperature detecting element.

* * * * *